United States Patent [19]

Brooks et al.

[11] 4,100,090

[45] Jul. 11, 1978

[54] ELECTRICAL DEVICES CONTAINING SILACYCLOPENTENE DIELECTRIC FLUIDS

[75] Inventors: William T. Brooks; Gary E. Legrow, both of Midland, Mich.

[73] Assignee: Dow Corning Corporation, Midland, Mich.

[21] Appl. No.: 794,272

[22] Filed: May 5, 1977

[51] Int. Cl.[2] ..... H01B 3/46; H01B 3/24; H01B 3/20

[52] U.S. Cl. ..... 252/63.7; 336/94; 361/315

[58] Field of Search ..... 252/63.7; 174/17 LF, 174/110 S; 336/94; 361/315, 327; 260/448.2 Q, 448.2 R

[56] References Cited

U.S. PATENT DOCUMENTS

| | | | |
|---|---|---|---|
| 1,931,455 | 12/1933 | Clark | 174/17 LF X |
| 3,509,191 | 4/1970 | Atwell | 260/46.5 R X |

*Primary Examiner*—Harris A. Pitlick
*Attorney, Agent, or Firm*—Jack E. Moermond

[57] ABSTRACT

Electrical devices such as transformers and capacitors containing certain silacyclopentenes as dielectric fluids are disclosed.

13 Claims, No Drawings

ELECTRICAL DEVICES CONTAINING SILACYCLOPENTENE DIELECTRIC FLUIDS

In numerous electrical devices it is necessary to provide a liquid insulating medium which is called a "dielectric fluid." This liquid has a substantially higher breakdown strength than air and by displacing air from space between conductors in the electrical equipment or apparatus, materially raises the breakdown voltage of the electrical device. With the ever increasing sophistication of electrical equipment, the various electrical devices are operating at higher and higher voltages. This means that the dielectric fluids used in such devices are subjected to greater and greater stresses. These problems have, of course, necessitated the search for improved dielectric fluids.

Polychlorinated biphenyl compounds (generally known as "PCB's") have been a standard dielectric fluid in electrical devices since the 1930's when the PCB's replaced mineral oil in certain applications. Various other liquids including some siloxanes have also been suggested for use as dielectric fluids. See for example U.S. Pat. Nos. 2,377,689 and 3,838,056 and British Pat. Nos. 899,658 and 899,661. Also, siloxane fluids containing additives have been suggested heretofore. See for example U.S. Pat. Nos. 3,948,789 and 3,984,338. Recently the PCB's have lost favor in the sight of environmentalists and, be they right or wrong, efforts are being made worldwide to find suitable replacements for the PCB's.

By way of illustration corona or partial discharge is a major factor causing deterioration and failure of capacitors or other power factor correction devices. A capacitor operating in corona will have a life of only minutes or hours instead of the expected 20 years. A capacitor properly impregnated with a suitable dielectric fluid will be essentially free of corona discharge to a voltage of at least twice the rated voltage. During use when a dielectric fluid is placed under increasing stress a point is reached where partial breakdown or corona occurs. The voltage at which the capacitor will suddenly flash into corona is known in the art as the corona inception voltage (CIV). This voltage is dependent upon the rate at which the voltage is applied. There is considerable difference between the sensitivity of different fluids to the rate of rise of voltage. The corona will, however, extinguish with a reduction of voltage. The corona extinction voltage (CEV) is not a fixed value for each fluid but is a function of the intensity of corona before the voltage is reduced. For best results both the CIV and CEV should be as high and as close together as possible.

It has been discovered in accordance with this invention that certain silacyclopentenes can be advantageously employed as dielectric fluids in electrical devices. It is believed that these silacyclopentenes when used as dielectric fluids provide suitable replacements for the PCB's which are currently being employed in the marketplace.

More specifically, this invention relates to an electrical device containing a dielectric fluid wherein the improvement comprises employing as the dielectric fluid a siloxane having the general formula

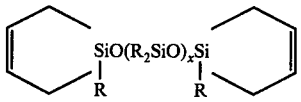

wherein each R is independently selected from the group consisting of methyl, phenyl, chloropropyl, and 3,3,3-trifluoropropyl radicals, and $x$ is an integer.

The fluid siloxanes (sometimes referred to as silacyclopentenes) useful in the present invention as defined by the above formula are described various places in the literature (see for example U.S. Pat. No. 3,509,191) and hence no details with regard to their preparation need be given here.

As indicated above the R radicals in the siloxanes can be methyl, phenyl, chloropropyl, or 3,3,3-trifluoropropyl radicals or various combinations of these radicals. The preferred siloxanes are those in which a combination of phenyl and methyl radicals, or all methyl radicals are present, with the all methyl siloxanes being most preferred at this time primarily for economic reasons.

The average number of diorganosiloxane units in the above formula is designated by the symbol $x$. As stated above, $x$ is an integer. This $x$ can be, for example, 0, 1, 2, 3, 5, 10, 20, 50, 100, 175, or larger so long as the siloxane remains a fluid. Preferably the number of diorganosiloxane units should be such to give a fluid with a viscosity in the range of 5 to 500 cs.

The dielectric fluid compositions of this invention may also contain small amounts of conventional additives such as HCl scavengers, corrosion inhibitors and other conventional additives normally employed as such compositions as long as they do not have an adverse effect of the performance of the compositions of this invention.

The two most important electrical devices in which the dielectric fluids of this invention are useful are in capacitors and transformers. They are also very useful dielectric fluids in other electrical devices such as electrical cables, rectifiers, electromagnets, switches, fuses, circuit breakers and as coolants and insulators for dielectric devices such as transmitters, receivers, fly-back coils, sonar buoys, toys and military "black boxes." The methods for employing the dielectric fluids in these various applications (be they, for example, as a reservoir of liquid or as an impregnant) are well known to those skilled in the art. For best results, the viscosity of the dielectric fluid composition of this invention should be in the range of 5 to 500 centistokes at 25° C. If the viscosity exceeds 500 centistokes they are difficult to use as impregnants and at less than 5 centistokes their volatility becomes a problem.

Now in order that those skilled in the art may better understand how the present invention can be practiced the following examples are given by way of illustration and not by way of limitation. All parts and percents referred to herein are by weight and all viscosities measured at 25° C. unless otherwise specified.

EXAMPLE 1

A mixture of dimethyldichlorosilane and methylchlorosilacyclopentene were cohydrolyzed and condensed to obtain a fluid siloxane having the general formula

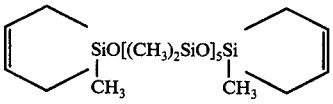

This fluid siloxane was found to have the following dielectric properties.

| Frequency (Hz) | Dielectric Constant | Dissipation Factor | Volume Resistivity (ohm-cm) |
|---|---|---|---|
| 100 | 2.74 | 0.00002 | $9 \times 10^{15}$ |
| 100,000 | 2.74 | 0 | — |

Two types of test capacitors were prepared for evaluation of the above prepared fluid siloxane using the known procedure set forth in detail in Example 2 of U.S. Pat. No. 3,948,789. One type (designated "FF" in the table below) was wound using two layers of 0.0005 inch thick polypropylene film between the aluminum electrodes. The other type (designated "FPF" in the table below) was wound using two layers of the 0.0005 inch thich polypropylene film with one layer of 0.004 inch thick kraft paper sandwiched between the polypropylene films between the aluminum electrodes. Voltage was applied to these capacitors using a Variac control attached to the primary of a high voltage transformer. For purposes of comparison such capacitors were also impregnated with a commercial PCB dielectric fluid (Aroclor 1016). The tests results are set forth in the table below.

| Dielectric Fluid | Capacitor Type | CIV (volts) | CEV (volts) |
|---|---|---|---|
| Commercial PCB | FF | 2400 | 1900 |
| Commercial PCB | FPF | 2400 | 1900 |
| Above fluid siloxane | FF | 2900 | 1800 |
| Above fluid siloxane | FPF | 3100 | 2200 |

EXAMPLE 2

A fluid siloxane of the general formula

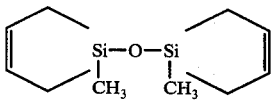

was prepared and found to have the following dielectric properties.

| Frequency (Hz) | Dielectric Constant | Dissipation Factor | Volume Resistivity (ohm-cm) |
|---|---|---|---|
| 100 | 2.64 | 0.00193 | $2.8 \times 10^{13}$ |
| 100,000 | 2.64 | 0 | $2.8 \times 10^{13}$ |

Test capacitors were prepared as in the previous example and the test results are set forth in the table below.

| Dielectric Fluid | Capacitor Type | CIV (volts) | CEV (volts) |
|---|---|---|---|
| Commercial PCB | FF | 2400 | 1900 |
| Commercial PCB | FPF | 2400 | 1900 |
| Above fluid siloxane | FF | 4100 | 3200 |

-continued

| Dielectric Fluid | Capacitor Type | CIV (volts) | CEV (volts) |
|---|---|---|---|
| Above fluid siloxane | FPF | 4100 | 3000 |

EXAMPLE 3

A mixture of 305.45 g. (1.25 moles) of diphenyldimethoxysilane, 263.02 g. (1.25 moles) of 1-methyl-1-silacyclopentene-3 dimer, 0.65 g. (0.004 mole, 0.1 weight percent) of trifluoromethane sulfonic acid, and 80.1 g. (2.5 moles) of methanol was refluxed for 1 hour and 25 minutes. Distilled water, 27 g. (1.5 moles), was added to the mixture within a 30 minute time span. The resulting mixture was refluxed for 1.5 hours after which the volatiles were stripped to 80° C. at atmospheric pressure. An additional 26.3 g. (0.125 mole) of 1-methyl-1-silacyclopentene-3 dimer was added along with 31.25 g. (0.52 mole) of isopropanol. After refluxing the resulting mixture for 4 hours at 80° C., 10 g. (0.1 mole) of calcium carbonate were added to neutralize the sulfonic acid catalyst. The resulting crude product was filtered through acid washed supercel. Gas-liquid chromatographic analysis of the filtered product indicated that an 80 percent yield of a fluid siloxane of the general formula

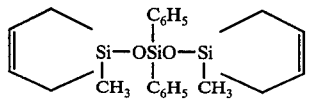

was obtained. A sample of pure product was obtained by vacuum distillation and found to have a boiling point of 167°-169° C. at 0.5 mm of mercury pressure; a refractive index of $N_D^{25}=1.5391$; a density of $d_4^{25}=1.061$; and a molar refraction $R_D=0.2953$ observed as compared to the calculated value of $R_D=0.2958$.

The above prepared crude product was found to have the following dielectric properties.

| Frequency (Hz) | Dielectric Constant | Dissipation Factor | Volume Resistivity (ohm-cm) |
|---|---|---|---|
| 100 | 2.84 | 0.00040 | $1.3 \times 10^{13}$ |
| 100,000 | 2.85 | 0.00037 | $1.3 \times 10^{13}$ |

Test capacitors of the FF type were prepared as in the previous examples and the text results are set forth in the table below.

| Dielectric Fluid | CIV (volts) | CEV (volts) |
|---|---|---|
| Commercial PCB | 2400 | 1700 |
| Above fluid siloxane | 4000 | 2900 |

EXAMPLE 4

A silacyclopentene fluid of the general formula

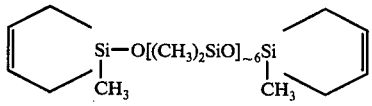

and having a viscosity of about 4.4 cs. was prepared by reacting a mixture of dimethylcyclosiloxanes and 1-methyl-1-silacyclopentene in the presence of trifluoromethane sulfonic acid catalyst. This product was found to have the following dielectric properties.

| Frequency (Hz) | Dielectric Constant | Dissipation Factor | Volume Resistivity (ohm-cm) |
|---|---|---|---|
| 100 | 2.72 | 0.00046 | $7.4 \times 10^{13}$ |
| 100,000 | 2.72 | 0.00002 | $7.4 \times 10^{13}$ |

Test capacitors of both the FF and FPF type were prepared and tested as in the previous examples using the above product as the dielectric fluid. These capacitors had a CIV and 3100 volts and a CEV of 2200 volts.

EXAMPLE 5

To a large beaker containing heptane there was added a mixture of 145 g. of methylchlorosilacyclopentene and 95 g. of pyridene. To this mixture there was added 200 g. of $HO[(CH_3)_2SiO]_3H$. Reaction of the chlorosilane and hydroxyl endblocked siloxane proceeded at room temperature. The reaction mixture was filtered, ammonia bubbled through, and then refiltered. The product was then placed in a 1 liter boiling flask and the heptane distilled off using a Vigireaux column to separate. During distillation the pyridene hydrochloride formed during the reaction solidified in the column necessitating stopping the distillation and cleaning the column. Ammonia was again bubbled through the product followed by filtration of the residue, and then distillation of the heptane finished in the cleaned system. The resulting product was agitated with Fuller's Earth overnight and then filtered to obtain a fluid having a viscosity of about 8.4 cs. and the general formula

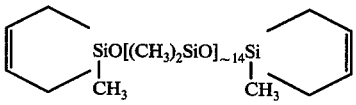

The above product was found to have the following dielectric properties.

| Frequency (Hz) | Dielectric Constant | Dissipation Factor | Volume Resistivity (ohm-cm) |
|---|---|---|---|
| 100 | 2.72 | 0.00030 | $8 \times 10^{13}$ |
| 100,000 | 2.72 | 0 | $8 \times 10^{13}$ |

Test capacitors of both the FF and FPF type were prepared and tested as in the previous examples using the above product as the dielectric fluid. These capacitors had a CIV of 2800 volts and a CEV of 1900 volts.

That which is claimed is:

1. In an electrical device containing a dielectric fluid, the improvement comprising employing as the dielectric fluid a siloxane having the general formula

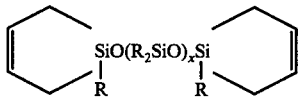

wherein each R is independently selected from the group consisting of methyl, phenyl, chloropropyl, and 3,3,3-trifluoropropyl radicals, and $x$ is an integer.

2. A device as defined in claim 1 wherein the fluid has a viscosity in the range of 5 to 500 cs. at 25° C.

3. A device as defined in claim 2 wherein in the fluid some of the R's are methyl radicals and some of the R's are phenyl radicals.

4. A device as defined in claim 2 wherein in the fluid all of the R's are methyl radicals.

5. A device as defined in claim 4 wherein $x$ is zero.

6. A device as defined in claim 4 wherein $x$ has an average value of about five.

7. A device as defined in claim 1 which is a capacitor.

8. A device as defined in claim 4 which is a capacitor.

9. A device as defined in claim 1 which is a transformer.

10. A device as defined in claim 4 which is a transformer.

11. A device as defined in claim 3 wherein the R radicals attached to the silacyclopentene silicon atoms are methyl radicals, the R radicals attached to all the other silicon atoms are phenyl radicals, and $x$ has an average value of 1.

12. A device as defined in claim 11 which is a capacitor.

13. A device as defined in claim 11 which is a transformer.

* * * * *

UNITED STATES PATENT AND TRADEMARK OFFICE

CERTIFICATE OF CORRECTION

PATENT NO. : 4,100,090

DATED : July 11, 1978

INVENTOR(S) : WILLIAM T. BROOKS, ET AL.

It is certified that error appears in the above-identified patent and that said Letters Patent are hereby corrected as shown below:

Column 1, line 9, "space" should read --spaces--.

Column 5, line 16, "CIV and 3100" should read --CIV of 3100--.

Signed and Sealed this

*Sixth* Day of *February 1979*

[SEAL]

*Attest:*

RUTH C. MASON
*Attesting Officer*

DONALD W. BANNER
*Commissioner of Patents and Trademarks*